US010393080B2

(12) United States Patent
Serra et al.

(10) Patent No.: US 10,393,080 B2
(45) Date of Patent: Aug. 27, 2019

(54) COUPLING DEVICE

(75) Inventors: Giandomenico Serra, S.Giuliano Terme (IT); Gisella Di Domizio, San Giuliano Terme (IT); Edoardo Giorgetti, Rosignano Marittimo (IT); Daniel Marc, Leghorn (IT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 410 days.

(21) Appl. No.: 13/637,080

(22) PCT Filed: Mar. 16, 2011

(86) PCT No.: PCT/EP2011/053960
§ 371 (c)(1),
(2), (4) Date: Sep. 25, 2012

(87) PCT Pub. No.: WO2011/117127
PCT Pub. Date: Sep. 29, 2011

(65) Prior Publication Data

US 2013/0008411 A1 Jan. 10, 2013

(30) Foreign Application Priority Data

Mar. 25, 2010 (EP) ..... 10003222

(51) Int. Cl.
*F02M 61/14* (2006.01)
*F02M 55/02* (2006.01)
*F02M 69/46* (2006.01)

(52) U.S. Cl.
CPC ..... *F02M 61/14* (2013.01); *F02M 55/025* (2013.01); *F02M 69/465* (2013.01);
(Continued)

(58) Field of Classification Search
CPC ..... F02M 59/32; F02M 37/0047; F02M 37/0052; F02M 55/002; F02M 55/004;
(Continued)

(56) References Cited

U.S. PATENT DOCUMENTS 1,963,535 A * 6/1934 Trotter ..... 411/156
4,307,693 A * 12/1981 Glockler ..... F02M 55/004 123/469

(Continued)

FOREIGN PATENT DOCUMENTS

EP 0945611 A2 9/1999 ..... F02B 17/00
EP 1262652 A2 12/2002 ..... F02F 1/24

(Continued)

OTHER PUBLICATIONS

European Search Report, Application No. 10003222.6, 4 pages, dated Aug. 27, 2010.

(Continued)

*Primary Examiner* — John M Zaleskas
*Assistant Examiner* — Susan E Scharpf
(74) *Attorney, Agent, or Firm* — Slayden Grubert Beard PLLC

(57) ABSTRACT

A coupling device for coupling a fuel rail to a cylinder head of a combustion engine may include: a fuel injector cup coupled to the fuel rail and facing the cylinder head, a first fastening element facing the fuel injector cup and fixedly coupled to the cylinder head, at least one first spring element arranged between the first fastening element and the fuel injector cup and/or between the fuel injector cup and the cylinder head, a support element arranged between the fuel rail and the cylinder head and fixedly coupled to the fuel rail, a second fastening element engaged with the support element and fixedly coupled to the cylinder head, and at least one second spring element arranged between the second (Continued)

fastening element and the support element and/or between the support element and the cylinder head. The first spring element(s) may comprise metal, and the second spring element(s) may comprise plastic.

16 Claims, 3 Drawing Sheets

(52) U.S. Cl.
CPC ..... *F02M 2200/03* (2013.01); *F02M 2200/09* (2013.01); *F02M 2200/803* (2013.01); *F02M 2200/855* (2013.01); *F02M 2200/857* (2013.01)

(58) Field of Classification Search
CPC .... F02M 55/005; F02M 55/008; F02M 55/02; F02M 55/025; F02M 55/026; F02M 55/04; F02M 61/14; F02M 69/465; F02M 2200/03; F02M 2200/09; F02M 2200/803; F02M 2200/855; F02M 2200/857
USPC ..... 123/456, 468–471
See application file for complete search history.

(56) References Cited

U.S. PATENT DOCUMENTS 4,516,555 A 5/1985 Shioya et al. ..... 123/470
4,519,368 A * 5/1985 Hudson, Jr. ..... F02M 69/465 123/468
4,991,557 A * 2/1991 DeGrace ..... F02M 51/005 123/468
5,044,338 A * 9/1991 Shelton ..... 123/469
5,056,975 A * 10/1991 Ando ..... 411/155
5,724,946 A * 3/1998 Franchitto ..... F02M 55/004 123/468
5,803,034 A * 9/1998 Gruber et al. ..... 123/90.38
5,970,953 A * 10/1999 Lorraine ..... F02M 61/14 123/456
6,237,571 B1 * 5/2001 Harrison ..... 123/469
6,340,019 B1 * 1/2002 Eshleman et al. ..... 123/469
6,431,151 B1 * 8/2002 Gmelin ..... 123/470
6,640,784 B1 * 11/2003 Sims, Jr. ..... 123/470
7,028,668 B1 * 4/2006 West ..... F02M 55/025 123/456
7,334,571 B1 * 2/2008 Beardmore ..... 123/470
7,475,675 B2 * 1/2009 Hiraya et al. ..... 123/470
7,527,038 B2 * 5/2009 Watanabe et al. ..... 123/470
2007/0221176 A1 * 9/2007 Hardy ..... 123/470
2008/0075403 A1 * 3/2008 Holt et al. ..... 384/551
2008/0302336 A1 * 12/2008 Fuerst et al. ..... 123/470
2009/0064972 A1 * 3/2009 Abe et al. ..... 123/456
2009/0159049 A1 * 6/2009 Sakagami ..... F02M 61/14 123/456
2011/0094472 A1 * 4/2011 Schreiner ..... F02M 55/025 123/294
2012/0204837 A1 * 8/2012 Harvey ..... F02M 61/14 123/469

FOREIGN PATENT DOCUMENTS

EP 1967728 A1 * 9/2008 ..... F02M 61/14
EP 1967728 A1 9/2008 ..... F02M 55/00
EP 2363593 A1 * 9/2011 ..... F02M 55/025
EP 2363593 A1 * 9/2011 ..... F02M 55/025
WO 2011/117127 A1 9/2011 ..... F02M 55/02

OTHER PUBLICATIONS

International Search Report and Written Opinion, Application No. PCT/EP2011/053960, 7 pages, dated May 9, 2011.

* cited by examiner

COUPLING DEVICE

CROSS-REFERENCE TO RELATED APPLICATIONS

This application is a U.S. National Stage Application of International Application No. PCT/EP2011/053960 filed Mar. 16, 2011, which designates the United States of America, and claims priority to EP Application No. 10003222.6 filed Mar. 25, 2010, the contents of which are hereby incorporated by reference in their entirety.

TECHNICAL FIELD

This disclosure relates to a coupling device for mechanically coupling a fuel rail to a cylinder head of a combustion engine.

BACKGROUND

Coupling devices for mechanically coupling a fuel rail to a cylinder head of a combustion engine are in widespread use, in particular for internal combustion engines. Fuel can be supplied to an internal combustion engine by the fuel rail through a fuel injector. The fuel rail can be coupled to the cylinder head in different manners.

In order to keep pressure fluctuations during the operation of the internal combustion engine at a very low level, internal combustion engines are supplied with a fuel accumulator to which the fuel injectors are connected and which has a relatively large volume. Such a fuel accumulator is often referred to as a common rail. Known fuel rails comprise a hollow body with recesses in form of fuel injector cups, wherein the fuel injectors are arranged.

SUMMARY

In one embodiment, a coupling device for mechanically coupling a fuel rail to a cylinder head of a combustion engine, the coupling device comprises: a fuel injector cup being designed to be hydraulically and mechanically coupled to the fuel rail and being arranged and designed to face the cylinder head, a first fastening element facing the fuel injector cup and being designed to be fixedly coupled to the cylinder head, at least one first spring element being arranged between the first fastening element and the fuel injector cup and/or being arrangeable between the fuel injector cup and the cylinder head, a support element being arranged between the fuel rail and the cylinder head and being designed to be fixedly coupled to the fuel rail, a second fastening element being in engagement with the support element and being designed to be fixedly coupled to the cylinder head, and at least one second spring element being arranged between the second fastening element and the support element and/or being arrangeable between the support element and the cylinder head, wherein the at least one first spring element consists of a metal or comprises a metal, and the at least one second spring element consists of a plastic or comprises a plastic.

In a further embodiment, one first spring element is arranged between the first fastening element and the fuel injector cup and a further first spring element is arrangeable between the fuel injector cup and the cylinder head, and the first spring elements consist of a metal or comprise a metal. In a further embodiment, one second spring element is arranged between the second fastening element and the support element and a further second spring element is arrangeable between the support element and the cylinder head, and the second spring elements consist of a plastic or comprise a plastic. In a further embodiment, at least one of the fastening elements is a screw.

BRIEF DESCRIPTION OF THE DRAWINGS

Example embodiments will be explained in more detail below with reference to figures, in which.

DETAILED DESCRIPTION

Figure 1:
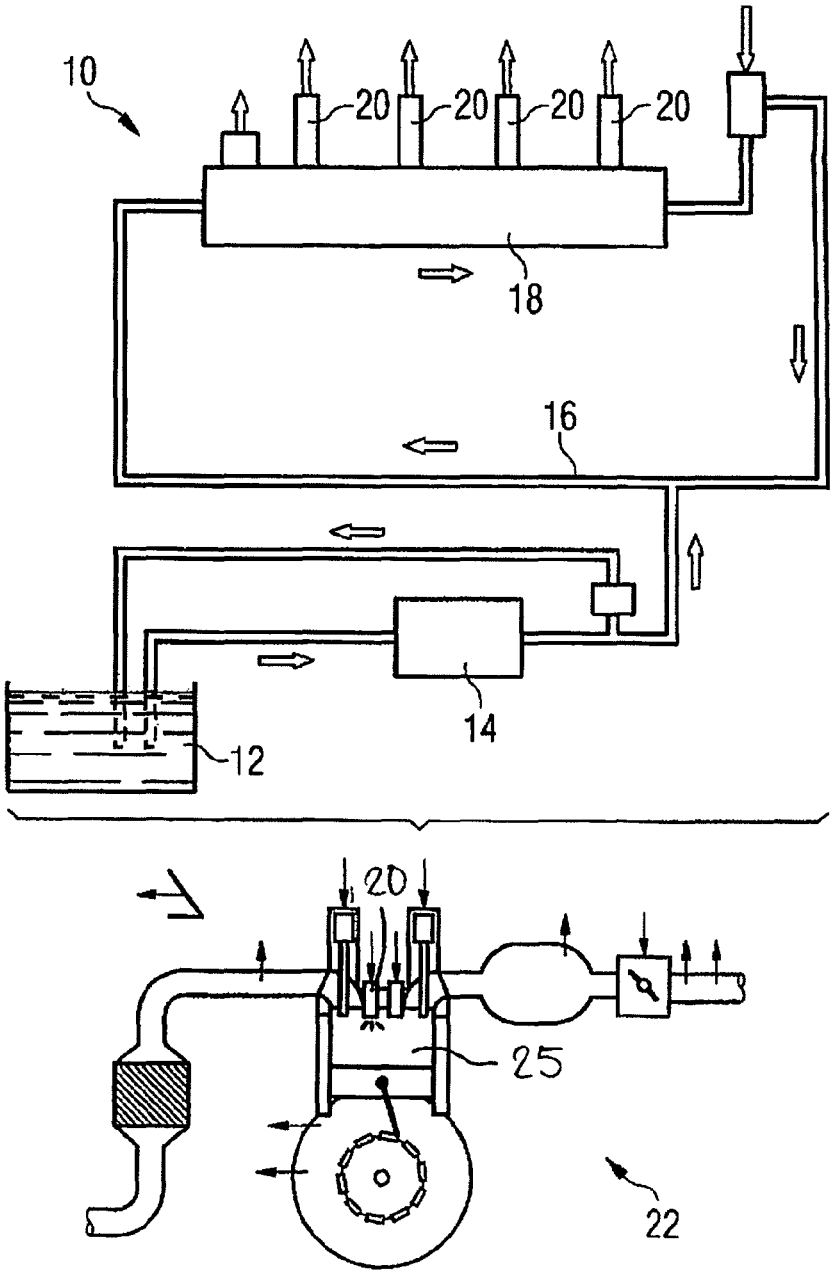
FIG. 1 shows an example internal combustion engine in a schematic view.

Some embodiments provide a coupling device for mechanically coupling a fuel rail to a cylinder head of a combustion engine which is simply to be manufactured and which facilitates a reliable and precise coupling between the fuel rail and the cylinder head.

For example, some embodiments provide a coupling device for mechanically coupling a fuel rail to a cylinder head of a combustion engine. The coupling device comprises a fuel injector cup being designed to be hydraulically and mechanically coupled to the fuel rail and being arranged and designed to face the cylinder head, a first fastening element facing the fuel injector cup and being designed to be fixedly coupled to the cylinder head, at least one first spring element being arranged between the first fastening element and the fuel injector cup and/or being arrangeable between the fuel injector cup and the cylinder head, a support element being arranged between the fuel rail and the cylinder head and being designed to be fixedly coupled to the fuel rail, a second fastening element being in engagement with the support element and being designed to be fixedly coupled to the cylinder head, and at least one second spring element being arranged between the second fastening element and the support element and/or being arrangeable between the support element and the cylinder head. The at least one first spring element consists of a metal or comprises a metal, and the at least one second spring element consists of a plastic or comprises a plastic.

The at least one first spring element consisting of a metal or comprising a metal can keep the displacement of the fuel injector cup small. Furthermore, the at least one second spring element consisting of a plastic or comprising a plastic can compensate the tolerances of the components of the fuel rail and the cylinder head to achieve a minimum mechanical stress for these components.

In one embodiment one first spring element is arranged between the first fastening element and the fuel injector cup and a further first spring element is arrangeable between the fuel injector cup and the cylinder head. The first spring elements consist of a metal or comprise a metal. This may have the advantage that the coupling of the fuel injector cup with the cylinder head allows an assembly of the cylinder head and the fuel rail without a direct contact between the cylinder head and the fuel injector cup. Consequently, a noise transmission between the cylinder head and the fuel rail can be kept small.

In a further embodiment one second spring element is arranged between the second fastening element and the support element and a further second spring element is arrangeable between the support element and the cylinder head. The second spring elements consist of a plastic or comprise a plastic. This may have the advantage that the coupling of the support element with the cylinder head allows an assembly of the cylinder head and the fuel rail without a direct contact between the cylinder head and the support element. Consequently, a noise trans-mission between the cylinder head and the fuel rail can be kept small.

In a further embodiment at least one of the fastening elements is a screw.

Figure 3:
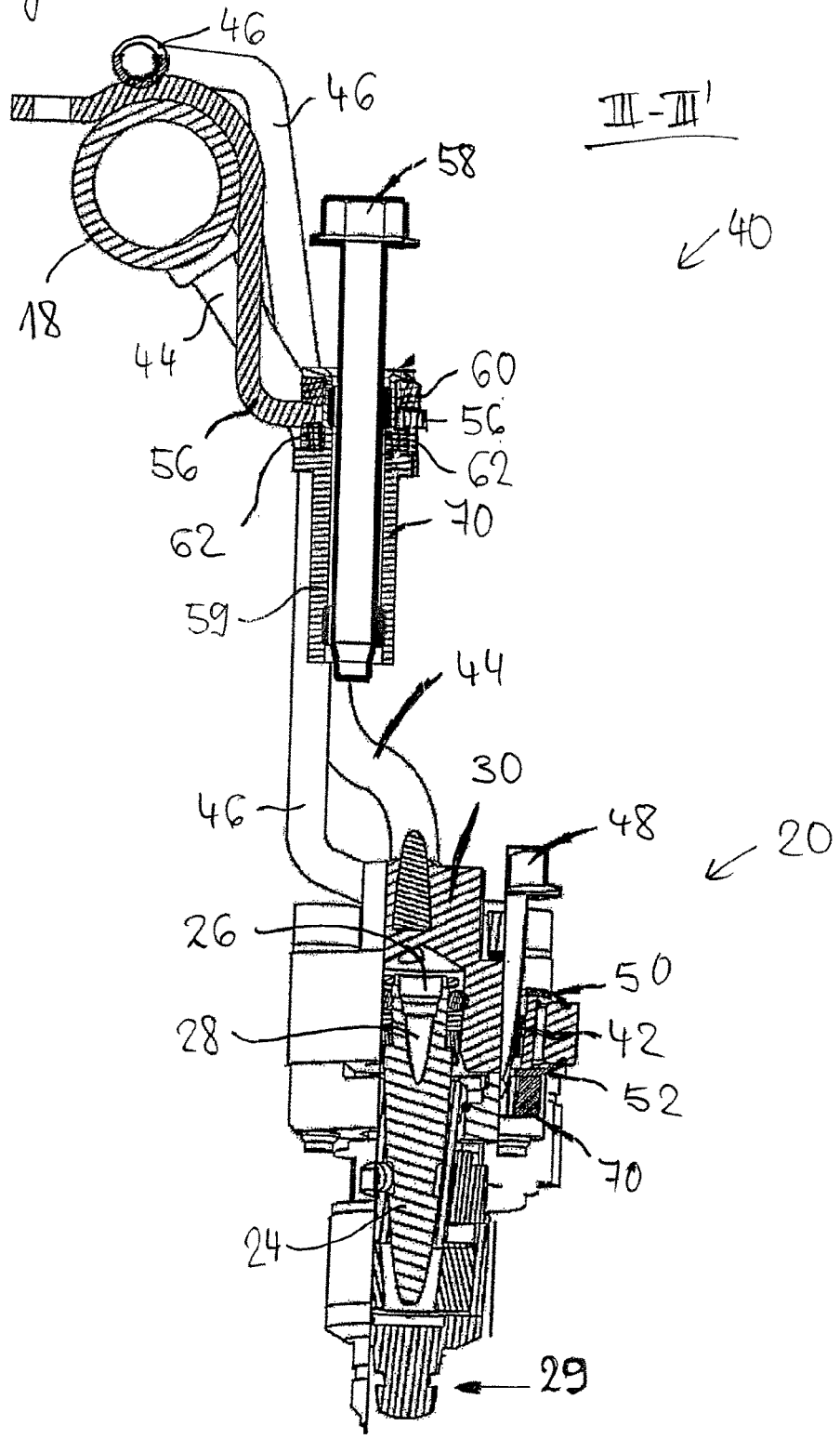
FIG. 3 shows the example coupling device in a longitudinal sectional view along line III-III' of FIG. 2.

As shown in FIG. 1, a fuel feed device 10 is assigned to an internal combustion engine 22 which can be a diesel engine or a gasoline engine. It includes a fuel tank 12 that is hydraulically connected with a fuel pump 14. The output of the fuel pump 14 is connected to a fuel inlet 16 of a fuel rail 18. In the fuel rail 18, the fuel is stored for example under a pressure of about 200 bar in the case of a gasoline engine or of about 2,000 bar in the case of a diesel engine. Fuel injectors 20 are connected to the fuel rail 18 and the fuel is fed to the fuel injectors 20 via the fuel rail 18. The fuel injectors 20 are arranged in a cylinder head 70 of the internal combustion engine 22 (FIG. 3). In some embodiments, the fuel injectors 20 are not in direct contact with the cylinder head 70.

Figure 2:
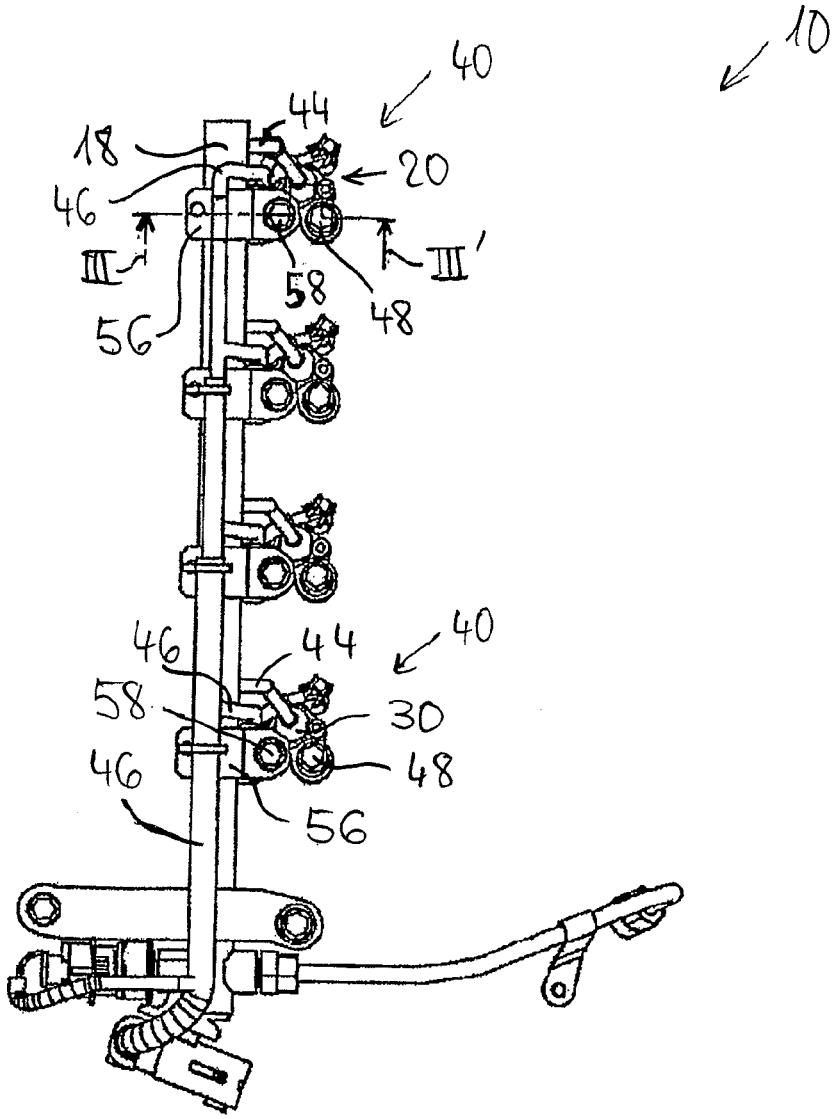
FIG. 2 shows an example fuel feed device with a coupling device in a perspective view.

FIG. 2 shows a perspective view of the fuel feed device 10. FIG. 3 shows the fuel feed device 10 with the fuel injector 20. The fuel injector 20 has a fuel injector body 24. The fuel injector 20 is suitable for injecting fuel into a combustion chamber 25 of the internal combustion engine 22 (FIG. 1). The fuel injector 20 comprises a fuel inlet portion 26. Furthermore, a cavity 28 is arranged in the fuel injector body 24. In an injection mode fuel can flow from the fuel inlet portion 26 to the cavity 28 and further to an injection nozzle 29. Subsequently, the fuel may be injected into the combustion chamber 25. In a non-injecting mode a fuel flow through the cavity 28 and an injection of fuel into the combustion chamber 25 is prevented.

The fuel feed device 10 comprises a fuel injector cup 30 which is part of a coupling device 40. The fuel injector cup 30 is in engagement with the fuel inlet portion 26 of the fuel injector 20. The fuel injector cup 30 has a through hole 42.

The fuel injector cup 30 is mechanically and hydraulically coupled to the fuel rail 18 by a first pipe 44. The first pipe 44 enables a fluid flow from the fuel rail 18 to the fuel injector 20. The fuel feed device 10 comprises a second pipe 46. The second pipe 46 enables a fluid flow from the fuel injector 20 back to the fuel tank 12.

The coupling device 40 further comprises a first fastening element 48. In the shown embodiment, the first fastening element 48 is a screw. The first fastening element 48 is extending through the through hole 42. The first fastening element 48 is in engagement with the cylinder head 70. If the fastening element 48 is a screw, the fastening element 48 can be fixedly coupled to the cylinder head 70.

The coupling device 40 further comprises first spring elements 50, 52. One first spring element 50 is arranged axially between the fastening element 48 and the fuel injector cup 30. Another first spring element 52 is arranged axially between the fuel injector cup 30 and the cylinder head 70. The first spring elements 50, 52 consist of a metal or comprise a metal.

The coupling device 40 further comprises a support element 56 which is arranged between the fuel rail 18 and the cylinder head 70. The support element 56 is shaped as a bracket and is fixedly coupled to the fuel rail 18, for example by brazing or welding.

The coupling device 40 further comprises a second fastening element 58 which is in engagement with the support element 56. In the shown embodiment, the second fastening element 58 is a screw. The second fastening element 58 is extending into a blind hole 59 which is arranged in the cylinder head 70. If the second fastening element 58 is a screw, it can be in engagement with the cylinder head 70. By this the second fastening element 58 can be fixedly coupled to the cylinder head 70.

The coupling device 40 further comprises second spring elements 60. One second spring element 60 is arranged between the second fastening element 58 and the support element 56. A further second spring element 62 is arranged between the support element 56 and the cylinder head 70. The second spring elements 60, 62 consist of a plastic or comprise a plastic.

Due to the first spring elements 50, 52 a direct contact between the cylinder head 70 and the fuel injector cup 30 can be prevented. Consequently, a noise transmission between the cylinder head 70 and the fuel rail 18 can be kept small. A possible advantage that the first spring elements 50, 52 consist of a metal or comprise a metal is that the displacement of the fuel injector cup 30 and the fuel injector 20 can be kept small. Consequently, the variation of the position of the injection nozzle 29 can be kept small. Consequently, a favorable spray distribution in the combustion chamber 25 can be obtained.

Due to the second spring elements 60, 62 a direct contact between the cylinder head 70 and the support element 56 can be prevented. Consequently, a noise transmission between the cylinder head 70 and the fuel rail 18 can be kept small. A possible advantage that the second spring elements 60, 62 consist of a plastic or comprise a plastic is that a high elasticity between the fuel rail 18 and the cylinder head 70 can be obtained. Consequently, the tolerances of the components of the fuel feed device 10 which may result in mechanical stress in particular during the mounting of the fuel feed device 10 can be compensated in a very good manner.

The use of a metal for the first spring elements 50, 52 and the use of a plastic for the second spring elements 60, 62 result in a very good combination of a low stress for the components of the fuel feed device 10 in particular during the mounting of the fuel feed device 10 and an exact positioning of the fuel injector 20 in the cylinder head 70.

What is claimed is:

1. Coupling device for mechanically coupling a fuel rail and a single fuel injector cup to a cylinder head of a combustion engine, the coupling device comprising:

the fuel injector cup being cup-shaped and configured to receive a fuel injector and configured for physical connection to a supply pipe for hydraulically coupling the fuel rail to a fuel chamber defined between the fuel injector and an interior surface of the fuel injector cup, a first fastening element extending through a hole in the single fuel injector cup into a first hole in the cylinder head to secure the single fuel injector cup to the cylinder head, a first spring element arranged between the first fastening element and the single fuel injector cup, the first spring element providing a dampened connection between the single fuel injector cup and the cylinder head, a fuel rail support element arranged between the fuel rail and the cylinder head, a second fastening element extending through the fuel rail support element and into a blind second hole in the cylinder head, connecting the fuel rail to the fuel rail support element and joining the fuel rail support element to the cylinder head remote from both the first fastening element and the single fuel injector cup, and a second spring element arranged between the second fastening element and the fuel rail support element, the second spring element providing a dampened connection between the fuel rail support element and the cylinder head, wherein the first spring element comprises a metal, and the second spring element comprises a plastic, wherein the connection between the fuel rail support element and the cylinder head including the plastic second spring element is more elastic than the connection between the single fuel injector cup and the cylinder head including the metal first spring element.

2. The coupling device of claim 1, further comprising a further first spring element arranged between the fuel injector cup and the cylinder head, and a fourth spring element arranged between the support element and the cylinder head.

3. The coupling device of claim 1, wherein at least one of the first and second fastening elements is a screw.

4. The coupling device of claim 1, wherein the fuel injector cup is configured to be hydraulically and mechanically coupled to the fuel rail by a pipe configured to enable a fluid flow from the fuel rail to a fuel injector.

5. The coupling device of claim 1, wherein the support element comprises a bracket.

6. The coupling device of claim 1, wherein the first spring element configured to prevent a direct contact between the cylinder head and the fuel injector cup.

7. The coupling device of claim 1, wherein the second spring element is configured to prevent a direct contact between the support element and the cylinder head.

8. The coupling device of claim 1, further comprising a further first spring element arranged between the fuel injector cup and the cylinder head, wherein the first spring element and the further first spring element provide a damped coupling between the fuel injector cup to the cylinder head along both a first axial direction of the first fastening element and a second opposite axial direction of the first fastening element, and wherein the further first spring element comprises a metal, and the second spring element comprises a plastic.

9. An engine, comprising:

a cylinder head, a fuel rail, a plurality of fuel injector cups, each fuel injector cup being cup-shaped and configured to receive a fuel injector and hydraulically and mechanically coupled to the fuel rail via a fuel supply pipe, to thereby hydraulically couple the fuel rail to a fuel chamber defined between an interior surface of the fuel injector cup and the fuel injector, one fuel rail support element for each of the plurality of fuel injectors cups arranged between the fuel rail and the cylinder head and fixedly coupled to the fuel rail, and a coupling device for mechanically coupling each of the plurality of fuel injector cups and the fuel rail to the cylinder head of a combustion engine, the coupling device comprising:

a first fastening element extending through a hole in the respective fuel injector cup to a respective first hole in the cylinder head, joining the respective fuel injector cup to the cylinder head, an associated first spring element arranged between the first fastening element and the fuel injector cup, the first spring element providing a dampened connection between the single fuel injector cup and the cylinder head, a second fastening element for each fuel injector cup extending through the fuel rail support element and into a respective second hole in the cylinder head, connecting the fuel rail to the fuel rail support element and joining the fuel rail support element to the cylinder head remote from both the first fastening element and the fuel injector cup, and an associated second spring element arranged between the second fastening element and the fuel rail support element, the second spring element providing a dampened connection between the fuel rail support element and the cylinder head, wherein the first spring element comprises a metal, and the second spring element comprises a plastic, wherein the connection between the fuel rail support element and the cylinder head including the plastic second spring element is more elastic than the connection between the single fuel injector cup and the cylinder head including the metal first spring element.

10. The engine of claim 9, further comprising a further second spring element arranged between the support element and the cylinder head.

11. The engine of claim 9, wherein at least one of the first and second fastening elements is a screw.

12. The engine of claim 9, wherein the fuel injector cup is configured to be hydraulically and mechanically coupled to the fuel rail by a pipe configured to enable a fluid flow from the fuel rail to a fuel injector.

13. The engine of claim 9, wherein the support element comprises a bracket.

14. The engine of claim 9, further comprising a further first spring element arranged between the fuel injector cup and the cylinder head, wherein the first spring element and the further first spring element are configured to prevent a direct contact between the cylinder head and the fuel injector cup.

15. The engine of claim 10, wherein the further second spring element and the second spring element are configured to prevent a direct contact between the support element and the cylinder head.

16. The engine of claim 9, wherein the coupling device further comprises a further first spring element arranged between the fuel injector cup and the cylinder head, wherein the first spring element and the further first spring element provide a damped coupling between the fuel injector cup to the cylinder head along both a first axial direction of the first fastening element and a second opposite axial direction of the first fastening element, and wherein the further first spring element comprises a metal, and the second spring element comprises a plastic.

* * * * *